US007713675B2

(12) United States Patent
Matsumoto et al.

(10) Patent No.: US 7,713,675 B2
(45) Date of Patent: May 11, 2010

(54) METHOD OF MANUFACTURING TONER

(75) Inventors: Katsuru Matsumoto, Nara (JP); Yasuhiro Shibai, Nara (JP); Satoru Ariyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/711,087

(22) Filed: Feb. 27, 2007

(65) Prior Publication Data

US 2007/0202433 A1 Aug. 30, 2007

(30) Foreign Application Priority Data

Feb. 28, 2006 (JP) ..... P2006-053744

(51) Int. Cl.
*G03G 7/00* (2006.01)

(52) U.S. Cl. ..... 430/137.19

(58) Field of Classification Search ..... 430/137.19
See application file for complete search history.

(56) References Cited

U.S. PATENT DOCUMENTS

| | | | | |
|---|---|---|---|---|
| 6,677,097 | B2 | 1/2004 | Ohmura et al. | |
| 6,821,703 | B2 * | 11/2004 | Uno et al. | 430/137.19 |
| 2003/0027066 | A1 | 2/2003 | Yamashita et al. | |
| 2004/0081907 | A1 * | 4/2004 | Akazawa et al. | 430/111.4 |
| 2006/1011575 | * | 6/2006 | Kim et al. | 430/109.4 |
| 2007/0128537 | A1 | 6/2007 | Ariyoshi et al. | |

FOREIGN PATENT DOCUMENTS

| | | |
|---|---|---|
| JP | 62-127750 | 6/1987 |
| JP | 62-127751 A | 6/1987 |
| JP | 62-127752 A | 6/1987 |
| JP | 3-32363 | 2/1990 |
| JP | 3-220203 | 9/1991 |
| JP | 5-181315 A | 7/1993 |
| JP | 8-305084 | 11/1996 |
| JP | 9-311502 | 12/1997 |
| JP | 10-312086 | 11/1998 |
| JP | 2000-292973 A | 10/2000 |
| JP | 2002-72562 | 3/2002 |
| JP | 2002-221824 A | 8/2002 |

(Continued)

OTHER PUBLICATIONS

Machine translation of JP 2005-258334 A1 (2005).*

(Continued)

*Primary Examiner*—Mark F Huff
*Assistant Examiner*—Peter L Vajda
(74) *Attorney, Agent, or Firm*—Nixon & Vanderhye P.C.

(57) ABSTRACT

There is provided a method of manufacturing a toner, using a shearing force for granulation, in which bubbles are prevented from arising upon application of the shearing force, thus manufacturing a diameter-reduced toner having a particle diameter of about 5 μm which is favorable for enhancement in definition and resolution of images. Upon granulating after a kneaded product of toner raw material is mixed with water dispersion, an interior part of granulating system is heated and pressurized and moreover, both of the shearing force and collision force are applied to the kneaded product of toner raw material by use of a high-speed rotating dispersion type granulator composed of a cylindrical pressure-resistant container, a spinning rotor, following screens, and a fixed screen.

16 Claims, 2 Drawing Sheets

FOREIGN PATENT DOCUMENTS

| | | | | |
|---|---|---|---|---|
| JP | 2002-292330 | A | | 10/2002 |
| JP | 2002-296839 | | | 10/2002 |
| JP | 2002-351140 | | | 12/2002 |
| JP | 2004-008898 | | * | 1/2004 |
| JP | 2005-36076 | A | | 2/2005 |
| JP | 2005-165039 | | | 6/2005 |
| JP | 2005-258334 | A1 | * | 9/2005 |
| JP | 2005-301061 | | | 10/2005 |
| JP | 2006-235030 | | | 9/2006 |

OTHER PUBLICATIONS

Translation of JP 2004-008898 published Jan. 2004.*
Patent Abstracts of Japan, Watanabe Hideki et al, 2002-040713, published Feb. 6, 2002, "Approximately Spherical Toner and Producing Method Thereof".
Japanese Patent Office machine-assisted translation of JP 2006-235030 (pub. Sep. 2006).
Neufeldt et al, Webster's New World Dictionary, Third College Edition, Simon & Schuster, Inc., NY (1988), p. 1234.
Claims filed Dec. 4, 2006 in U.S. Appl. No. 11/607,929.

* cited by examiner

METHOD OF MANUFACTURING TONER

CROSS-REFERENCE TO RELATED APPLICATION

This application claims priority to Japanese Patent Application No. JP 2006-53744, which was filed on Feb. 28, 2006, the contents of which, are incorporated herein by reference, in their entirety.

BACKGROUND OF THE INVENTION

1. Field of the Invention

The present invention relates to a method of manufacturing a toner.

2. Description of the Related Art

An electrophotographic image forming apparatus comprises an image forming process mechanism including: a photoreceptor; a charging section for charging a photoreceptor surface; an exposing section for irradiating with signal light the photoreceptor surface being charged, to form thereon an electrostatic latent image corresponding to image information; a developing section for supplying a toner contained in a developer to the electrostatic latent image formed on the photoreceptor surface, to form thereon a toner image; a transfer section provided with a transfer roller for transferring the toner image from the photoreceptor surface to a recording medium; a fixing section provided with a fixing roller for fixing the toner image onto the recording medium; and a cleaning section for cleaning the photoreceptor surface from which the toner image has been transferred. In the electrophotographic image forming apparatus, the electrostatic latent image is developed by use of a one-component developer containing a toner as a developer or by use of a two-component developer containing toner and carrier as developers so that an image is formed. Through the electrophotographic image forming apparatus, an image of favorable image quality can be formed at high speed and low cost. This promotes the use of the electrophotographic image forming apparatus in a copier, a printer, a facsimile, or the like machine, resulting in a remarkable spread thereof in recent years. Simultaneously, the image forming apparatus has faced up to more demanding requirements. Among such requirements, particular attentions are directed to enhancement in definition and resolution, stabilization of image quality, and an increase in image forming speed, regarding an image being formed by the image forming apparatus. In order to fulfill these demands, a two-way approach is indispensable in view of both the image forming process and the developer. Regarding the enhancement in definition and resolution of the image, the reduction in diameter of toner particles is one of problems to be solved from the aspect of the developer. This is based on the perspective such that it is important to authentically reproduce the electrostatic latent image.

Conventionally, a pulverization method, a polymerization method, a wet method, and the like method have been known as a method of manufacturing a toner. According to the pulverization method, an admixture of toner raw materials such as binder resin and a colorant is melt-kneaded, and a melt-kneaded product thus obtained is cooled down to be solidified, followed by pulverization and classification, in a consequence whereof a toner is obtained. The diameter-reduced toner manufactured by the pulverization method contains particles of which shapes are not uniform, and has an extremely deteriorated powder flowability. When such a toner is used, the toner is unevenly charged before supplied to an electrostatic latent image, for example, which possibly generates unevenness in density or color of an image being formed. According to the polymerization method, a monomer compound of binder resin, a colorant, and the like ingredients are evenly mixed in a solvent, followed by polymerization of the monomer compound of binder resin, in a consequence whereof a toner is obtained. The polymerization method has a drawback such that the binder resin is limited to vinylic polymers such as polyvinyl chloride, which can be manufactured by radical polymerization. The toner containing the vinylic polymer as binder resin is inferior to a toner containing polyester as binder resin, in terms of a fixing property onto a recording medium, transparency, and the like properties. According to the wet method, in a solvent containing an organic solvent, mixed are fine synthetic resin particles, a colorant, and other toner raw materials which are then coagulated, and a coagulated product thus obtained is heated, in a consequence whereof a toner is obtained. When the wet method is implemented in industrial scale, a large amount of waste liquid containing organic solvent is generated. Considering environmental problems, the waste liquid should not be disposed without treatment. Accordingly, there arises a need of establishing a large-scale disposing facility for collecting the organic solvent, resulting in a higher cost for manufacturing a toner as compared to the other methods.

Conventionally, various methods have been known how to manufacture a toner by applying a shearing force to the toner raw material in water. For example, there has been proposed a toner manufacturing method in which a polymeric monomer composition containing a polymeric monomer, a colorant, and a polymeric initiator is added under a shearing force to a water dispersion (of which pH is from 6.5 to 12) containing inorganic dispersants such as phosphoric salt, carbonate, hydroxide, sulfate, bentonite, silica, and alumina, and then mixed to obtain an admixture that is further subjected to a shearing force to thereby granulate the polymeric monomer composition, followed by suspension polymerization of granulated substances thus obtained, in a consequence whereof a toner is obtained (refer to, for example, Japanese Unexamined Patent Publication JP-A 10-312086 (1998)). Further, there has been proposed a toner manufacturing method in which a polymeric monomer composition containing a polymeric monomer and a colorant is added to a water dispersion containing an inorganic dispersant, and then mixed to obtain an admixture that is further subjected to a shearing force, a collision force, etc., to thereby granulate the polymeric monomer composition, followed by suspension polymerization of granulated substances thus obtained, in a consequence whereof a toner is obtained (refer to, for example, Japanese Unexamined Patent Publication JP-A 8-305084 (1996)). Regarding the toner manufacturing method in which a polymeric monomer composition containing a polymeric monomer and a colorant is added to a water dispersion containing an inorganic dispersant, and then mixed to thereafter granulate the polymeric monomer composition, followed by suspension polymerization of granulated substances thus obtained, in a consequence whereof a toner is obtained, there has been proposed that the polymeric monomer composition is granulated by means of a granulator comprising: an open-air cylindrical container; a spinning rotor which is provided in an internal space of the cylindrical container and supported on one face in a thickness direction of the cylindrical container so as to be rotatable, having a shaft center in common with the cylindrical container; a following screen having a shape of tube or bottomed tube, which has a shaft center in common with the cylindrical container and is provided around the spinning rotor so as to be rotatable with rotation of the spinning rotor, and of which peripheral wall is provided with a plurality of slits for flowing a liquid; and a fixed screen having a shape of tube or bottomed tube, which has a shaft center in common with the cylindrical container and is provided around the following screen, and of which peripheral wall is provided with a plurality of slits for flowing a liquid (refer to, for example, Japanese Unexamined Patent Publication JP-A 2-32363 (1990)). The granulator used in the method disclosed by JP-A 2-32363 is commercially available, and known granulator includes Ebara milder (trade name) manufactured by Ebara Corporation.

In those techniques disclosed in JP-A 10-312086, JP-A 8-305084, and JP-A 2-32363, a toner is obtained by adding the polymeric monomer composition to the water dispersion containing the inorganic dispersant, and then applying the shearing force, the collision force, etc. to granulate the polymeric monomer composition, followed by the suspension polymerization of the granulated substances. The inorganic dispersant has a function to prevent bubbles which have actions of coagulating and coarsening the toner, from arising upon application of the shearing force. In those techniques, however, the generation of bubbles cannot be sufficiently prevented, so that a part of the obtained toner is coarsened, resulting in uneven particle diameter and shape of the toner. Thus, those techniques have a drawback that a diameter-reduce toner as desired cannot be obtained. Furthermore, another known method is a fusion emulsification method in which a toner is manufactured by applying a shearing force to a melt-kneaded product of toner raw materials in water. Also for the method, a technical improvement has been desired to obtain a toner having a further reduced diameter.

SUMMARY OF THE INVENTION

An object of the invention is to provide a method of manufacturing a toner, using a shearing force for granulation, in which bubbles are prevented from arising upon application of the shearing force, thus manufacturing a toner having a reduced approximately uniform particle diameter of around 5 μm and an approximately uniform shape.

The inventors have devised the invention through studies for solving the above problems. As a result of the studies, it turned out that in those techniques disclosed in JP-A 10-312086, JP-A 8-305084, and JP-A 2-32363, a large amount of bubbles are generated even in the presence of the inorganic dispersant because the shearing force is applied under normal pressure to not-yet-polymerized monomer dispersed in water. And a further study reveals that a desired toner can be obtained when the granulation is conducted by applying a shearing force and a collision force to a melt-kneaded product of toner raw material instead of the not-yet-polymerized monomer not under normal pressure but under increased heat and pressure.

The invention provides a method of manufacturing a toner, comprising granulating by applying a shearing force and a collision force to a kneaded product of toner raw material containing binder resin and a colorant in water under heat and pressure and in the presence of a dispersant.

According to the invention, the granulation is conducted by applying the shearing force and the collision force to the kneaded product of toner raw material in water under heat and pressure and in the presence of the dispersant, resulting in a toner of which particle size distribution is seen in a narrow range and of which particles are approximately uniform in diameter and shape. According to the manufacturing method of the invention, it is possible to easily obtain a toner having a very small diameter of about 5 μm, which is effectively used for enhancement in definition and resolution of an image. Accordingly, the use of the toner obtained by the manufacturing method of the invention easily enhances degrees of definition, resolution, and density of an image so that an image of high quality can be formed.

Further, in the invention, it is preferable that the binder resin is one or more ingredients selected from polyester, acrylic resin, polyurethane, and epoxy resin.

Further, in the invention, it is preferable that the binder resin is polyester.

According to the invention, the binder resin used in the manufacturing method of the invention is preferably polyester, acrylic resin, polyurethane, or epoxy resin. Among those ingredients, the polyester resin is particularly preferable. By use of these binder resins, it is possible to obtain a toner which is high in fixing strength onto a recording medium and excellent in color reproducibility. In particular, the use of polyester makes it possible to obtain a toner which is more excellent in color reproducibility and thus suitable for formation of a color image.

Further, in the invention, it is preferable that the kneaded product of toner raw material contains a release agent and/or a charge control agent together with the binder resin and the colorant.

According to the invention, the kneaded product of toner raw material contains a release agent and/or a charge control agent together with the binder resin and the colorant, with the result that it is possible to obtain a toner which has a reduced diameter and exhibits high levels of various properties required for toner. In particular, when the release agent is contained in the kneaded product, it is possible to achieve a further reduction in diameter of the toner.

Further, in the invention, it is preferable that the dispersant is a water-soluble polymeric dispersant.

Further, in the invention, it is preferable that the water-soluble polymeric dispersant is one or more water-soluble polymeric dispersants selected from polyoxyalkylene alkylarylether sulfate salt and polyoxyalkylene alkylether sulfate salt.

According to the invention, the water-soluble polymeric dispersant which is preferably one or more water-soluble polymeric dispersants selected from polyoxyalkylene alkylarylether sulfate salt and polyoxyalkylene alkylether sulfate salt, is used as the dispersant, with the result that bubbles are further prevented from arising upon application of the shearing force, and the coarsening of toner particles caused by recoagulation thereof is thus prevented furthermore. Accordingly, the particle size distribution range can be narrower.

Further, in the invention, it is preferable that the shearing force and the collision force are applied to the kneaded product of toner raw materials under heat at a temperature in a range of from 50° C. to 150° C. and under a pressure in a range of from 0.13 MPa to 0.3 MPa.

According to the invention, when the shearing force and the collision force are applied under heat at a temperature in a range of from 50° C. to 150° C. and under a pressure in a range of from 0.13 MPa to 0.3 MPa, bubbles can be prevented from arising by synergetic effect, and even a kneaded product of toner raw material having a high viscosity can be granulated into a diameter-reduced toner for a relatively short period of time so that a diameter-reduced toner can be effectively manufactured in high yield.

Further, in the invention, it is preferable that the shearing force and the collision force are applied to the kneaded product of toner raw material containing the binder resin and the colorant by use of a granulator comprising: a cylindrical pressure-resistant container having an internal space, which can be hermetically closed; a spinning rotor which is provided in the internal space of the cylindrical pressure-resistant container and supported on one face or both faces in a thickness direction of the pressure-resistant container so as to be rotatable, having a shaft center in common with the pressure-resistant container; a following screen having a shape of tube or bottomed tube, which has a shaft center in common with the cylindrical pressure-resistant container and is provided around the spinning rotor so as to be rotatable with rotation of the spinning rotor, and of which peripheral wall is provided with a plurality of slits for flowing a liquid; and a fixed screen having a shape of tube or bottomed tube, which has a shaft center in common with the cylindrical pressure-resistant container and is provided around the following screen, and of which peripheral wall is provided with a plurality of slits for flowing a liquid.

According to the invention, the shearing force and the collision force are applied to the kneaded product of toner raw material by use of a granulator comprising: a hermetic type pressure-resistant cylindrical container; a spinning rotor provided inside the container so as to share its shaft center with the container; one or more following screens having a shape of tube or bottomed tube, which is provided around the spinning rotor and of which peripheral wall is provided with a plurality of slits for flowing a liquid; and one or more fixed screens having a shape of tube or bottomed tube, which is provided around the following screen and of which peripheral wall is provided with a plurality of slits for flowing a liquid, with the result that the bubbles being generated is further decreased so that an usage of the dispersant can be reduced and moreover, a loss of impact energy due to break of generated bubbles is reduced, thereby allowing reduction in power consumption for the manufacture. Furthermore, the kneaded product of toner raw material is subjected to the uniform shearing force so that the particle size distribution range is narrower, thus obtaining a toner having equally-sized particles.

Further, in the invention, it is preferable that the kneaded product of toner raw material containing the binder resin and the colorant is obtained by kneading the toner raw material in an open roll type kneader.

According to the invention, the toner raw material is kneaded by use of the open roll type kneader, with the result that the toner raw materials such as the binder resin and the colorant are evenly mixed to obtain a kneaded product which is easily granulated by application of the shearing force and the collision force.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
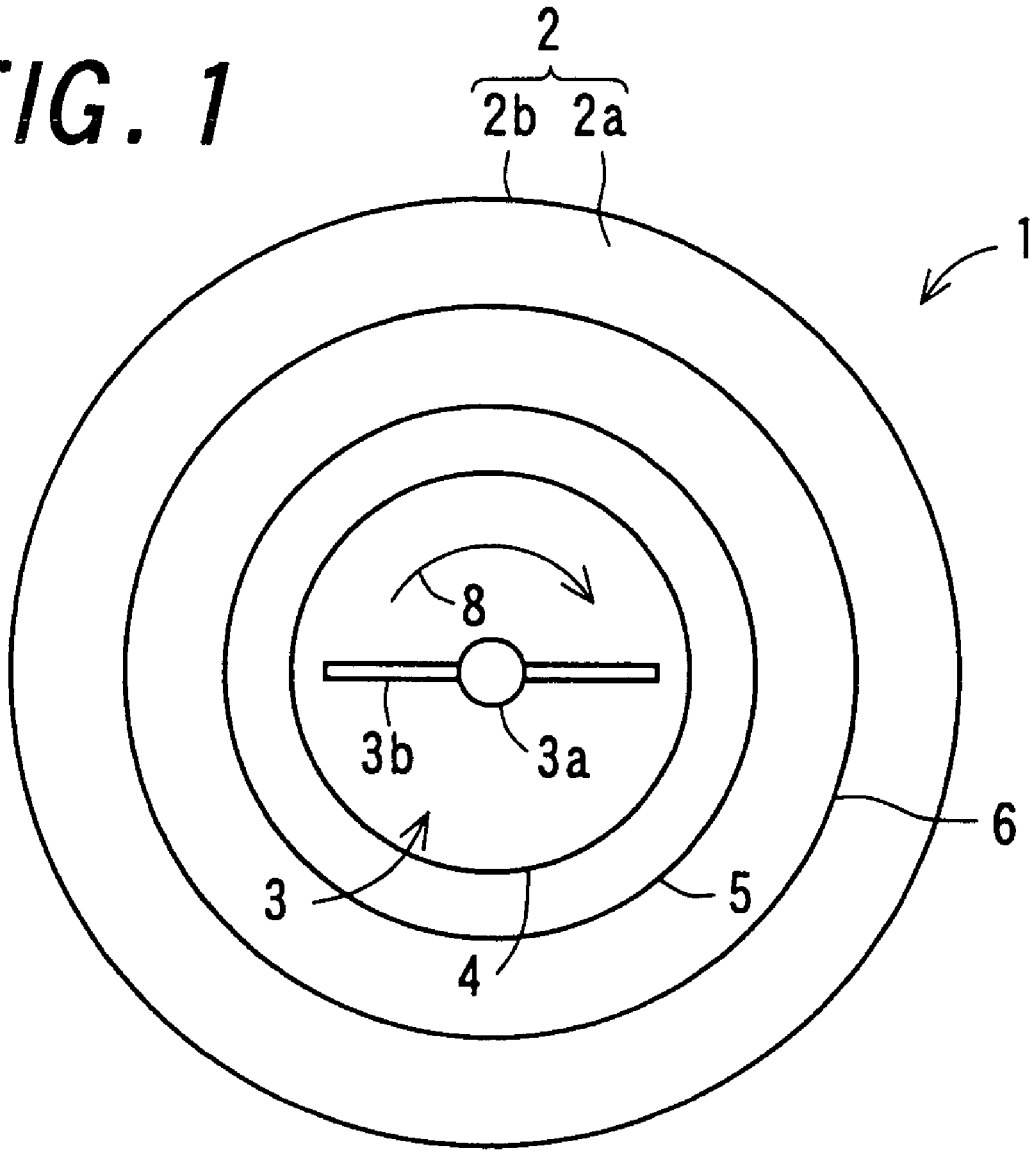
FIG. 1 is a top view schematically showing a configuration of one example of high-speed rotating dispersion type granulator.

Now referring to the drawings, preferred embodiments of the invention are described below.

A toner manufacturing method of the invention is characterized in that a granulation is conducted by applying a shearing force and a collision force to a kneaded product of toner raw material containing binder resin and a colorant in water under heat and pressure and in the presence of a dispersant. That is to say, the manufacturing method of the invention is characterized in that at a granulating process, heat and pressure are applied and not only the shearing force but also the collision force is applied. Other than the above features, the manufacturing method of the invention can be carried out as in the case of the conventional fusion emulsification method. The manufacturing method of the invention includes a kneaded product preparing step, water dispersion preparing step, a mixing step, a granulating step, and a cooling and drying step. At the kneaded product preparing step, a kneaded product of toner raw material is prepared. At the water dispersion preparing step, a dispersant-containing water dispersion is prepared. At the mixing step, the kneaded product of toner raw material and the water dispersion containing the dispersant are mixed with each other. At the granulating step, the kneaded product of toner raw material is granulated into fine particles. At the cooling and drying step, the fine particles obtained at the granulating step is cooled and dried to thus obtain a toner of the invention.

[Kneaded Product Preparing Step]

At the present step, the kneaded product of toner raw material is prepared. As a toner raw material, binder resin and a colorant are used. In addition, a commonly-used additive for toner such as a release agent and a charge control agent may be used.

As the binder resin, the selection of ingredients is not particularly limited as long as the ingredient can be granulated in its molten state, and it is thus possible to use heretofore known ingredients such as polyester, acrylic resin, polyurethane, and epoxy resin.

As polyester, heretofore known ingredients can be used, including a polycondensation of polybasic acid and polyhydric alcohol. As polybasic acid, those known as a monomer for polyester can be used, including: aromatic carboxylic acids such as terephthalic acid, isophthalic acid, phthalic acid anhydride, trimellitic acid anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. These polybasic acids may be used each alone or two or more of the polybasic acids may be used in combination. As polyhydric alcohol, those known as a monomer for polyester can also be used, including: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. These polyhydric alcohols may be used each alone or two or more of the polyhydric alcohols may be used in combination. Polycondensation reaction of polybasic acid and polyhydric alcohol can be effected in a common manner. For example, the polycondensation reaction is effected by contacting polybasic acid and polyhydric alcohol each other in the presence or absence of an organic solvent and in the presence of a polycondensation catalyst, and terminated at the instant when the acid value and the softening temperature of the resultant polyester stand at predetermined values. Polyester is thus obtained. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester.

As the acrylic resin, the selection of ingredients is not particularly limited, and acid group-containing acrylic resin can be preferably used. The acid group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. As the acrylic resin monomer, heretofore known ingredients can be used, including acrylic acid which may have a substituent, methacrylic acid which may have a substituent, acrylic acid ester which may have a substituent, and methacrylic acid ester which may have a substituent. The acrylic resin monomers may be used each alone or two or more of the acrylic resin monomers may be used in combination. Moreover, as the vinylic monomer, heretofore known ingredients can be used, including styrene, α-methylstyrene, vinyl bromide, vinyl chloride, vinyl acetate, acrylonitrile, and methacrylonitrile. These vinylic monomers may be used each alone or two or more of the vinylic monomers may be used in combination. The polymerization is effected by use of a commonly-used radical initiator in accordance with a solution polymerization method, a suspension polymerization method, an emulsification polymerization method, or the like method.

As the polyurethane, the selection of ingredients is not particularly limited, and acidic group- or basic group-containing polyurethane can be preferably used, for example. The acidic group- or basic group-containing polyurethane can be produced in accordance with a heretofore known method, for example, by subjecting acidic group- or basic group-containing diol, polyol, and polyisocyanate to an addition polymerization. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone or two or more of the components may be used in combination.

As the epoxy resin, the selection of ingredients is not particularly limited, and acidic group- or basic group-containing epoxy resin can be preferably used. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to epoxy resin which serves as a base.

Among these binder resins, polyester is preferred. Polyester is excellent in transparency and capable of providing the obtained toner particles with favorable powder flowability, low-temperature fixing property and secondary color reproducibility, thus being suitably used as binder resin for a color toner. Further, polyester and acrylic resin may also be used by grafting. Further, in the case where facilitation of granulating operation, a kneading property with the colorant, and equalization of shape and size of toner particles are taken into consideration, it is preferable to use binder resin having a softening temperature of 150° C. or lower, and particularly preferable to use binder resin having a softening temperature of from 60° C. to 150° C. Among such binder resins, preferred is binder resin of which weight-average molecular weight falls in a range of from 5,000 to 500,000. The binder resins may be used each alone or two or more of the binder resins may be used in combination. Furthermore, it is possible to use a plurality of resins of the same type, which are different in any one or all of molecular weight, monomer composition, and other factors.

Note that, in a case of manufacturing a capsule toner according to the manufacturing method of the invention, binder resin intended for a core material and binder resin intended for forming an outer shell are used.

As the binder resin intended for a core material, preferred is resin containing one or more monomers of styrenes, maleic acid monoesters, and fumaric acid monoesters. A content of the styrene monomer in binder resin is preferably 30% to 95% by weight and more preferably 40% to 95% by weight, based on a total amount of the monomer. A content of the monomer of maleic acid monoesters and/or fumaric acid monoesters is preferably 5% to 70% by weight and more preferably 5% to 50% by weight, based on a total amount of the monomer.

Examples of the styrene monomer contained in the binder resin intended for a core material include styrene, α-methyl styrene, styrene halide, vinyl toluene, 4-sulfonamide styrene, 4-styrene sulfonic acid, and divinylbenzene. Examples of the monomer of maleic acid monoesters include diethyl maleate, dipropyl maleate, dibutyl maleate, dipentyl maleate, dihexyl maleate, heptyl maleate, octyl maleate, ethylbutyl maleate, ethyloctyl maleate, butyloctyl maleate, butylhexyl maleate, and penetyloctyl maleate. Examples of the monomer of fumaric acid monoesters include diethyl fumarate, dipropyl fumarate, dibutyl fumarate, dipentyl fumarate, dihexyl fumarate, heptyl fumarate, octyl fumarate, ethylbutyl fumarate, ethyoctyl fumarate, butyloctyl fumarate, butylhexyl fumarate, and pentyloctyl fumarate.

Furthermore, in addition to the above-cited monomers, examples of the binder resin intended for a core material include a monomer of (meth)acrylic esters, a monomer of (meth)acrylamide alkyl sulfonic acids, a multifunctional (meth)acrylic monomer, and a monomer of peroxides. Examples of the monomer of (meth)acrylic esters include methyl(meth)acrylate, ethyl(meth)acrylate, propyl(meth) acrylate, n-butyl(meth)acrylate, isobutyl (meth)acrylate, octyl(meth)acrylate, dodecyl (meth)acrylate, lauryl(meth) acrylate, stearyl (meth)acrylate, cyclohexyl(meth)acrylate, phenyl (meth)acrylate, benzyl(meth)acrylate, furfuryl (meth) acrylate, hydroxylethyl(meth)acrylate, hydroxybutyl (meth) acrylate, dimethylaminomethyl ester(meth)acrylate, dimethylaminoethyl ester(meth)acrylate, 2-ethylhexyl (meth) acrylate, and 2-chloroethyl(meth)acrylate. Examples of the monomer of (meth)acrylamide alkyl sulfonic acids include acrylamidemethyl sulfonic acid, acrylamideethyl sulfonic acid, acrylamide n-propylsulfonic acid, acrylamide isopropylsulfonic acid, acrylamide n-butylsulfonic acid, acrylamide s-butylsulfonic acid, acrylamide t-butylsulfonic acid, acrylamide pentanesulfonic acid, acrylamide hexanesulfonic acid, acrylamide heptanesulfonic acid, acrylamide octanesulfonic acid, methacrylamide methylsulfonic acid, methacrylamide ethylsulfonic acid, methacrylamide n-propylsulfonic acid, methacrylamide isopropylsulfonic acid, methacrylamide n-butylsulfonic acid, methacrylamide s-butylsulfonic acid, methacrylamide t-butylsulfonic acid, methacrylamide pentanesulfonic acid, methacrylamide hexanesulfonic acid, methacrylamide heptanesulfonic acid, and methacrylamide octanesulfonic acid. Examples of the multifunctional (meth)acrylic monomer include 1,3-butyleneglycol diacrylate, 1,5-pentanediol diacrylate, neopentylglycol diacrylate, 1,6-hexanediol diacrylate, diethyleneglycol diacrylate, triethyleneglycol diacrylate, tetraethyleneglycol diacrylate, polyethyleneglycol diacrylate, polyethyleneglycol #400 diacrylate, polyethylene glycol #600 diacrylate, polypropylene diacrylate, N,N'-methylene bisacrylamide, pentaerythritol triacrylate, trimethylolpropane triacrylate, tetramethylolpropane triacrylate, 1,4-butanediol diacrylate, diethyleneglycol dimethacrylate, 1,3-butyleneglycol dimethacrylate, 1,5-pentanediol dimethacrylate, neopentylglycol dimethacrylate, 1,6-hexanediol dimethacrylate, diethyleneglycol dimethacrylate, triethyleneglycol dimethacrylate, tetraethyleneglycol dimethacrylate, polyethyleneglycol dimethacrylate, polyethyleneglycol #400 dimethacrylate, polyethyleneglycol #600 dimethacrylate, polypropylene dimethacrylate, N,N'-methylene bismethacrylamide, pentaerythritol trimethacrylate, trimethylolpropane trimethacrylate, tetramethylolpropane trimethacrylate, 1,4-butanediol dimethacrylate, 2,2-bis(4-methacryloxy polyethoxyphenyl) propane, aluminum methacrylate, calcium methacrylate, zinc methacrylate, and magnesium methacrylate. Examples of the monomer of peroxides include t-butylperoxy methacrylate, t-butylperoxy crotonate, di(t-butylperoxy)fumarate, t-butylperoxy allylcarbonate, pertrimellitic acid tri-t-butyl ester, pertrimellitic acid tri-t-aminoester, pertrimellitic acid tri-t-hexyl ester, pertrimellitic acid tri-t-1,1,3,3-tetramethyl butyl ester, pertrimellitic acid tri-t-cumyl ester, pertrimellitic acid tri-t-(p-isopropyl)cumyl ester, pertrimesic acid tri-t-butyl ester, pertrimesic acid tri-t-amino ester, pertrimesic acid tri-t-hexyl ester, pertrimesic acid tri-t-1,1,3,3-tetramethyl butyl ester, pertrimesic acid tri-t-cumyl ester, pertrimesic acid tri-t-(p-isopropyl)cumyl ester, 2,2-bis(4,4-di-t-butylperoxycyclohexyl)propane, 2,2-bis(4,4-di-t-hexylperoxycyclohexyl)propane, 2,2-bis(4,4-di-t-amylperoxycyclohexyl)propane, 2,2-bis(4,4-di-t-octylperoxycyclohexyl)propane, 2,2-bis(4,4-di-t-α-cumylperoxycyclohexyl)propane, 2,2-bis(4,4-di-t-butylperoxycyclohexyl)butane, and 2,2-bis(4,4-di-t-octylperoxycyclohexyl)butane. It is preferred that the binder resin intended for a core material be formed by two-stage polymerization of one or more of the above monomers. The two-stage polymerization can be effected by a solution polymerization method, a suspension polymerization method, an emulsification polymerization method, and the like method, among which the solution polymerization method is preferable. A molecular weight distribution curve of binder resin obtained by the two-stage polymerization shows at least two peaks, that is, at least one in a low-molecular range and one in a high-molecular range.

The core material may contain, as well as the above binder resin, styrene-acrylic resin, polyurethane, styrene-butadiene resin, polyester, and epoxy resin, for example.

Meanwhile, the outer shell is formed of thermoplastic resin which includes a vinylic polymer, polyester, epoxy resin, and polyurethane. Among these ingredients, the vinylic polymer and polyester are preferred. To be more specific, a styrene-n-butylacrylate copolymer, a styrene-methylmethacrylate-n-butylmethacrylate copolymer, and a condensation product of terephthalate-bisphenol A propylene oxide can be cited.

As the colorant, it is possible to use an organic dye, an organic pigment, an inorganic dye, and an inorganic pigments, which are commonly used in the electrophotographic field. A black colorant includes, for example, carbon black, copper oxide, manganese dioxide, aniline black, activated carbon, non-magnetic ferrite, magnetic ferrite, and magnetite. An yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138. An orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43. A red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222. A purple colorant includes, for example, manganese purple, fast violet B, and methyl violet lake. A blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60. A green colorant includes, for example, chromium green, chromium oxide, pigment green B, malachite green lake, final yellow green G, and C.I. pigment green 7. A white colorant includes, for example, those compound such as zinc white, titanium oxide, antimony white, and zinc sulfide. A use ratio of the binder resin to the colorant is not limited to a particular ratio. A typical usage of the colorant is preferably from 0.1 to 20 parts by weight, and more preferably from 0.2 to 10 parts by weight based on 100 parts by weight of the binder resin. The colorants may be used each alone or two or more of the colorants of different colors may be used in combination. Further, two or more of the colorants with the same color may be used in combination.

As the release agent, it is possible to use ingredients which are commonly used in this field, including: petroleum wax such as paraffin wax, a derivative thereof, microcrystalline wax, and a derivative thereof; hydrocarbon synthesis wax such as Fischer-Tropsch wax, a derivative thereof, polyolefin wax, a derivative thereof, low-molecular polypropylene wax, a derivative thereof, polyolefin copolymer wax (low-molecular polyethylene wax etc.), and a derivative thereof; plant-derived wax such as carnauba wax, a derivative thereof, rice wax, a derivative thereof, candelilla wax, a derivative thereof, and wood wax; animal-derived wax such as bee wax and whale wax; oil and fat synthesis wax such as fatty acid amide and phenol fatty acid ester; long-chain carboxylic acid and a derivative thereof; long-chain alcohol and a derivative thereof; silicone copolymer; and higher fatty acid. Note that the derivative includes an oxide, a block copolymer of a vinylic monomer and wax, and a graft denatured product of a vinylic monomer and wax. A usage of the wax is not limited to a particular level and may be selected as appropriate from a wide range. A preferable usage of the wax is 0.2 to 20 parts by weight based on 100 parts by weight of the binder resin.

As the charge control agent, it is possible to use agents for controlling positive charges and agents for controlling negative charges, which are commonly used in this field. The charge control agent for controlling positive charges includes a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The charge control agent for controlling negative charges includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. The charge control agent may be used each alone and according to need, two or more of the agents may be used in combination. A usage of the charge control agent is not limited to a particular level and may be selected as appropriate from a wide range. A preferable usage of the charge control agent is 0.5 to 3 parts by weight based on 100 parts by weight of the binder resin.

The kneading of toner raw material is conducted, for example, by dry-mixing toner raw materials in a mixer and kneading the obtained admixture in a kneading machine. The kneading is conducted under heat at a temperature (usually about 80° C. to 200° C., preferably about 100° C. to 150° C.) which is equal to or higher than the melting temperature of the binder resin. Usable mixers includes heretofore known mixers including Henschel-type mixing apparatuses such as a Henschel mixer (trade name) manufactured by Mitsui Mining Co., a super mixer (trade name) manufactured by Kawata Co., and a MECHANO mill (trade name) manufactured by Okada Seiko Co., ONGU mill (trade name) manufactured by Hosokawa Micron Co., Hybridization system (trade name) manufactured by Nara Kikai Seisakusho Co., and Cosmo system (trade name) manufactured by Kawasaki Heavy Industry Co. As the kneading machine, it is possible to use commonly-used kneading machines such as a twin-screw extruder, three rolls, and laboplast mill. To be more specific, usable kneading machines include single or twine screw extruders such as TEM-100B (trade name) manufactured by Toshiba Kikai Co., PCM-65/87 (trade name) manufactured by Ikegai Co., and open roll systems such as Kneadics (trade name) manufactured by Mitsui Mining Co. Among these mixers, open roll systems are preferable. Note that the admixture of toner raw material may be prepared by granulating the colorant, the release agent, and the like ingredients into composite particles having a desired particle diameter, and then dry-mixing the composite particles with the binder resin, the charge control agent, the like ingredients by a mixer. The composite particles can be obtained by adding an appropriate amount of water, lower alcohol, and the like ingredients to the colorant, the release agent, and the like ingredients, which are then granulated by a commonly-used granulator such as a high-speed mill and dried.

[Dispersant Preparing Step]

At the present step, the aqueous solution or water dispersion of the dispersant is prepared. Hereinafter, the aqueous solution and the water dispersion will be collectively referred to as water dispersion unless otherwise specified. The water dispersion of the dispersant is prepared, for example, by dissolving or dispersing the dispersant into water.

As the dispersant, it is possible to use any ingredients which are commonly used in this field, including a less water-soluble salt, an inorganic high polymer, a metal oxide, a metal hydroxide, and a water-soluble polymeric dispersant. Examples of the less water-soluble salt include calcium phosphate, barium sulfate, calcium sulfate, barium carbonate, calcium carbonate, and magnesium carbonate. Examples of the inorganic high polymer include silicate. Examples of the metal oxide include aluminum oxide and titanium oxide. Examples of the metal hydroxide include aluminum hydroxide, magnesium hydroxide, and ferric hydroxide. Examples of the water-soluble polymeric dispersant includes: polyoxyethylene polymers such as (meth)acrylic polymer, polyvinyl alcohol, methylcellulose, gelatin, polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; cellulose polymers such as methylcellulose, hydroxyethylcellulose, and hydroxypropylcellulose; polyoxyalkylene alkylarylether sulfate salts such as sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetyiphenylether sulfate, ammonium polyoxyethylene laurylphenylether sulfate, ammonium polyoxyethylene nonylphenylether sulfate, and ammonium polyoxyethylene oleylphenylether sulfate; and polyoxyalkylene alkylether sulfate salts such as sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate, which contains one or two hydrophilic monomers selected from: acrylic monomers such as (meth)acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, and diethyleneglycol dimethacrylate. Among these dispersants, the water-soluble polymeric dispersant is preferable, and particularly preferable are polyoxyalkylene alkylarylether sulfate salts and polyoxyalkylene alkylether sulfate salts. The dispersants may be used each alone or two or more dispersants may be used in combination. A usage of the dispersant is not limited to a particular amount, and a total amount of the water and dispersant is preferably 0.05% to 10% by weight and more preferably 0.1% to 3% by weight.

Note that an electrical conductivity of the water into which the dispersant is dispersed or dissolved, is preferably 20 μS/cm or less and more preferably 10 μS/cm. Such water can be obtained, for example by an activated carbon method, an ion exchanging method, a distillation method or a reverse osmosis method. As a matter of course, two or more of the methods may be combined for the preparation of water. An equipment for manufacturing water having a low conductivity is commercially available, including a super pure water preparation apparatus: Ultra Pure Water System CPW-102 (trade name) manufactured by ADVANTEC Co. The conductivity of water can be measured by using a Lacom Tester EC-PHCON 10 (trade name) manufactured by Iuchi Seieido Co., Ltd. Further, in manufacturing the capsule toner, it is preferred that methanol be added together with the dispersant. An addition amount of methanol is not limited to a particular amount, and the addition amount of methanol is preferably 1% to 5% by weight of a total amount of the water and methanol. As in the case of the water-soluble polymeric dispersant, methanol has been also preferably added to water in advance before the toner coarse particles are added to the water.

[Mixing Step]

At the present step, the kneaded product of toner raw material and the dispersant-containing water dispersion are mixed with each other. The mixing is preferably conducted by adding the kneaded product of toner raw material to the dispersant-containing water dispersion. A mixing ratio between the kneaded product of toner raw material and the dispersant-containing water dispersion is not limited to a particular ratio, and may be appropriately selected from a wide range according to various conditions such as a type of binder resin, a type of release agent, a type of dispersant, and a density of dispersant in the water dispersion containing the dispersant. A usage of the dispersant is preferably 0.1 to 10 parts by weight and more preferably 0.1 to 3.0 parts by weight based on 100 parts by weight of the kneaded product of toner raw material.

[Granulating Step]

At the present step, the shearing force and the collision force are applied to the admixture of the kneaded product of toner raw material and the dispersant-containing water dispersion under heat and pressure so that granulation is conducted to obtain fine particles of the kneaded product. Note that the mixing of the kneaded product of toner raw material and the dispersant-containing water dispersion and the granulation may be conducted at the same time.

Figure 2:
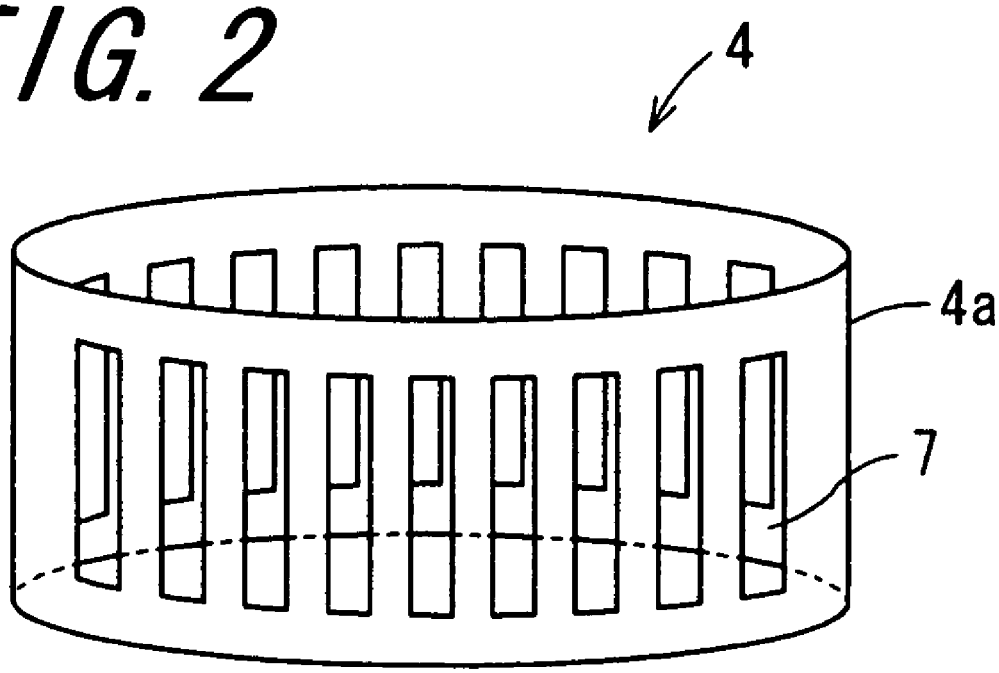
FIG. 2 is a perspective view schematically showing a configuration of following screen provided in the high-speed rotating dispersion type granulator shown in FIG. 1.

The dispersant-containing water dispersion containing the kneaded product of toner raw material is preferably heated to 50° C. to 150° C. and pressurized at preferably 0.13 to 0.3 MPa, and more preferably heated to 80° C. to 120° C. and pressurized at 0.13 MPa to 0.2 MPa. The shearing force and the collision force are applied under heat and pressure to the dispersant-containing water dispersion containing the kneaded product of toner raw material, whereby fine toner particles are granulated from the kneaded product of the toner raw material. The shearing force and the collision force are applied by use of, for example, a granulator 1 shown in FIG. 1. FIG. 1 is a top view schematically showing a configuration of the granulator 1 by which the shearing force and the collision force are applied at the same time (hereinafter referred to as "high-speed rotating dispersion type granulator 1"). FIG. 2 is a perspective view schematically showing a configuration of a following screen 4 which is a constituent of the high-speed rotating dispersion type granulator 1 shown in FIG. 1.

The high-speed rotating dispersion type granulator 1 comprises a cylindrical pressure-resistant container 2, a spinning rotor 3, following screens 4, 5, and a fixed screen 6. The cylindrical pressure-resistant container 2 is a hermetically-closable container-shaped member having an internal space 2*a* defined by an outer wall 2*b* and both sides (not shown) in a thickness direction. A Heating section (not shown) is disposed in a vicinity of the cylindrical pressure-resistant container 2. Further, to the cylindrical pressure-resistant container 2 are connected a pressurizing section, a supply pipe of the dispersant-containing water dispersion containing the kneaded product of toner raw material, a discharge pipe of the water dispersion containing granulated toner particles, and the like elements, all of which are not shown. Furthermore, the cylindrical pressure-resistant container 2 has a pressure adjusting valve (not shown). The spinning rotor 3 is a stirring member composed of: a rotary shaft 3*a* which is provided in the internal space 2*a* of the cylindrical pressure-resistant container 2 and supported on one face or both faces in a thickness direction of the pressure-resistant container 2 so as to be rotatable in an arrow 8 direction by use of a driving section (not shown), having a shaft center in common with the pressure-resistant container 2; and a pair of stirring blades 3*b* extending in a radial direction of the pressure-resistant container 2 from a peripheral face of the rotary shaft 3*a*. A peripheral velocity of the spinning rotor 3 is not limited to a particular level, and a preferable velocity is 30 to 60 m/s. This velocity represents 9600 to 19000 rpm of the number of rotation per minute of the spinning rotor 3. The following screen 4 is a tube-shaped or bottomed-tube-shaped member which has a shaft center in common with the cylindrical pressure-resistant container 2 and is provided around the spinning rotor 3 so as to be rotatable with rotation of the spinning rotor 3, and of which peripheral wall 4*a* is provided with a plurality of slits 7 for allowing a liquid to flow through. The following screen 5 has the same configuration as that of the following screen 4 although the following screen 5 is provided around the following screen 4. The fixed screen 6 is a tube-shaped or bottomed-tube-shaped member which has a shaft center in common with the cylindrical pressure-resistant container 2 and is provided around the following screen 5, and of which peripheral wall is provided with a plurality of slits for allowing a liquid to flow through as in the case of the following screens 4 and 5. The fixed screen 6 which is supported on one face or both faces in the thickness direction of the cylindrical pressure-resistant container 2, is thus never driven to rotate by rotation of the spinning rotor 3.

In the high-speed rotating dispersion type granulator 1, the spinning rotor 3 is driven to rotate under heat and pressure at predetermined levels with the internal space 2*a* of the cylindrical pressure-resistant container 2 filled up with the dispersant-containing water dispersion containing the kneaded product of toner raw material so that the following screens 4 and 5 are driven to rotate. The kneaded product of toner raw material is subjected to a centrifugal force generated by rotation of the rotor 3 and following screens 4 and 5, thus flowing from a vicinity of the shaft center of the cylindrical pressure-resistant container 2 toward the container outer wall 2*b*. And then, the kneaded product of toner raw material is subjected to the shearing force upon passing through the slit 7 for flowing a liquid, of the following screens 4 and 5, to then collide with the fixed screen 6 or to then pass through a slit (not shown) for flowing a liquid, of the fixed screen 6 and in even such a case, collide with the container outer wall 2*b*, thereby being subjected to the collision force. As just described, the shearing force and the collision force are repeatedly applied to the kneaded product of toner raw material so that the kneaded product is granulated into fine particles. The high-speed rotating dispersion type granulator is stated in Japanese Unexamined Patent Publication JP-A 2004-8898, for example, and commercially offered from Nihon BII Co., Ltd.

[Cooling and Drying Step]

At the present step, the water dispersion containing the fine particles obtained at the granulating step is cooled down to about a room temperature to thereby sort out a cooled and solidified product of fine particles from the water dispersion by a commonly-used solid-liquid separating device such as centrifugal separation and filtration, and the cooled and solidified product is dried, whereby the toner of the invention is obtained. The toner of the invention is a toner which has a very small diameter of about 5 μm and of which particle size distribution is narrower and particles are more uniform in shape as compared to the conventional toner.

When needed, the toner of the invention is mixed with a commonly-used external additive and then used. As the external additive, it is possible to use heretofore known additives including fluidity improvers such as oxidized silicon, titanium silicon, silicon carbide, aluminum oxide, and barium titanate. The fluidity improvers may be used each alone or two or more of the fluidity improvers may be used in combination. A usage of the fluidity improver is not limited to a particular amount, and preferably 0.1 to 3.0 parts by weigh based on 100 parts by weight of the toner of the invention.

The toner of the invention can be used as it is in form of one-component developer, or alternatively, may be mixed with a carrier to be used in form of two-component developer. As the carrier, it is possible to use heretofore known magnetic particles. Specific examples of the magnetic particles include metals such as iron, ferrite, and magnetite, and alloys formed of these metals and metals such as aluminum and lead. Among these ingredients, ferrite is preferable. A resin layer may be provided on a surface of the carrier. Examples of synthetic resin used for the resin layer include olefin resin, styrene resin, styrene/acryl resin, silicone resin, ester resin, and fluorine-containing polymer resin. A particle diameter of the carrier is not limited to a particular size, and in consideration of enhancement in image quality, a preferable particle diameter is 30 to 50 μm. A resistivity of carrier is preferably $10^8$ Ω·cm or more and more preferably $10^{12}$ Ω·cm or more. The resistivity is a value obtained in such a manner that the particles are put in a container having a cross-sectional area of 0.50 $cm^2$, followed by tapping, and then a load of 1 $kg/cm^2$ is put on the particles stuffed in the container, thereafter a current value is read upon application of such a voltage as to generate an electric field of 1000 V/cm between the load and a bottom electrode. A low resistivity causes charge injection into the carrier particles upon application of bias voltage to a developing sleeve so that the carrier particles are more liable to be attached to an image carrier surface and moreover, the bias voltage breakdown is more liable to occur. The magnetization intensity (maximum magnetization) of carrier is 10 to 60 emu/g and more preferably 15 to 40 emu/g. A use ratio of toner to carrier contained in the two-component developer is not limited to a particular ratio and may be appropriately selected according to types of toner and carrier. For example, when using a resin-coated carrier (having a density of 5 to 8 $g/cm^2$), an amount of toner being contained in the developer may be selected to fall in a range of from 2% to 30% by weight and preferably from 2% to 20% by weight of a total amount of the developer.

EXAMPLES

Hereinafter, the invention will be described more in detail with reference to Example 1 and Comparative example 1. Hereinbelow, "%" and "part" indicate "% by weight" and "part by weight", respectively, unless otherwise specified.

Example 1

Kneaded Product Preparing Step

There were provided 8 parts of carbon black particles acting as a colorant: NIPX 60 (trade name) manufactured by Degussa, Inc., 5 parts by weight of ester wax particles acting as a release agent: WEP-5 (trade name) manufactured by NOF Corporation, 90 parts of polyester acting as binder resin (having a softening temperature Tm of 125° C. and a glass transition temperature Tg of 58° C.) manufactured by Kao Corporation, and 2 parts of a charge control agent: TRH (trade name) manufactured by Hodogaya Chemical Co., Ltd. These constituent components were mixed by using a mixer: Henschel Mixer (trade name) manufactured by Mitsui Mining Co., Ltd. to obtain a raw material admixture. By using a twin-screw extruding and kneading machine: PCM-30 (trade name) manufactured by Ikegai Co., Ltd., the obtained raw material admixture was kneaded at a kneading temperature T1 of 140° C. obtained by (Tm+15° C.), which is higher than a softening temperature Tm of the binder resin by 15° C. And a kneaded product was thus obtained. As a screw of the twin-screw extruding and kneading machine, there was used a screw which was 30 mm in outer dimension D and 1 m in length dimension L in a rotation axial direction so that a ratio L/D of the length dimension L to the outer dimension D was 33.

[Water Dispersion Preparing Step]

An aqueous solution containing 20% by weight of a dispersant was prepared by blending and dissolving an ammonium salt of styrene-acrylic acid copolymer acting as a dispersant: Joncryl 52 (trade name) manufactured by Johnson Polymer Corporation in ion-exchanged water (having an electrical conductivity of 8 μS/cm) in a manner so as to insure that the solid matter concentration of the dispersant stands at 20% by weight.

[Mixing Step and Granulating Step]

Next, 100 parts of the kneaded product and 400 parts of the aqueous solution containing 20% by weight of the dispersant obtained as described above were put in a cylindrical pressure-resistant container made of metal having a pressure adjusting valve, a heating section and a rotor starter type stirring section, which container is, to be specific, a high-speed rotating dispersion type granulator: a bubbleless mixer (trade name) manufactured by Nihon BII Co., Ltd., to be then granulated for 10 minutes on conditions that a rotary speed of a spinning rotor (having an outer diameter of 30 mm) was 10,000 rpm, a granulating temperature was 150° C., and a granulating pressure was 0.17 MPa. Fine particles of the kneaded product of toner raw material were thus obtained.

[Cooling and Drying Step]

The heating operation was brought to a halt with the spinning rotor rotating at a speed of 10,000 rpm inside the cylindrical pressure-resistant container so that the dispersant-containing water dispersion containing fine particles was cooled down until a liquid temperature thereof decreased to 20° C. After the cooling, the dispersant-containing water dispersion containing fine particles was taken out of the cylindrical pressure-resistant container to be subjected to filtering for sorting out the fine particles which are then dried in a vacuum drier for 8 hours at a temperature of 50° C. The toner of the invention was thus obtained. By using the following particle size measuring method, it was found out that the obtained toner particles had a volumetric average particle diameter of 5.3 μm and a variable coefficient (CV) of 32. Thereafter, 0.6 part of hydrophobized colloidal silica: RX-300 (trade name) manufactured by Nippon Aerosil Co., Ltd. was added to 100 parts of the obtained toner particles, which were then mixed by using the Henschel mixer so that the toner of the invention was obtained.

[Particle Size Measuring Method]

A sample for measurement was prepared in such a manner that 0.5 ml of alkyl benzene sulfonate (dispersant) and 3 mg of toner sample were sequentially added to 20 ml of an aqueous solution (electrolytic solution) containing 1% by weight of (primary) sodium chloride, followed by ultrasonic dispersion for 5 minutes, and an aqueous solution containing 1% by weight of (primary) sodium chloride was further added thereto so that a total amount reaches 100 ml, followed by ultrasonic dispersion for another 5 minutes. As to the sample for measurement, the measurement was conducted by Coulter Counter TA-III (trade name) manufactured by Coulter Inc. in which conditions were set such that an aperture diameter was 100 μm, a diameter of to-be-measured particle was 2 to 40 μm on a quantity basis, and the number of to-be-measured particles was 50,000 counts. Through the measurement, the volumetric average particle diameter and a standard deviation in a volume particle size distribution were obtained. The variable coefficient (CV) was calculated by the following expression:

$CV(\%)$=[standard deviation in volume particle size distribution]/[volumetric average particle diameter]×100

Comparative Example 1

There were provided 80.5 parts of styrene, 19.5 parts of n-butylacrylate, 0.3 part of polymethacrylic ester macromonomer, 0.5 part of divinylbenzene, 1.2 parts of t-dodecyl mercaptan, 7 parts of carbon black: #25 (trade name) manufactured by Mitsui Chemicals, Inc., 1 part of charge control agent: spiron black TRH (trade name) manufactured by Hodogaya Chemical Co., Ltd., and 2 parts of Fischer-Tropsch wax acting as a release agent: Paraflint Spray 30 (trade name) manufactured by Sasol, Inc. By using a ultrasonic emulsification equipment, these constituent components were subjected to a fine dispersion treatment and stirred until liquid droplets were stabilized. To the resultant admixture was added 6 parts of t-butylperoxy-2-ethylhexanoate acting as a polymerization initiator: Perbutyl O (trade name) manufactured by NOF Corporation. Thereafter, a granulator: Ebara Milder (trade name) manufactured by Ebara Seisakusho Co.) was used to give a high shearing force to stir the resultant admixture so that liquid droplets of monomer admixture were granulated. The obtained liquid droplets of the monomer admixture were put in a reactor equipped with a stirring blade, and a polymerization reaction was started at 85° C. After a polymerization inversion rate has reached approximately 100%, 0.3 part of 2,2'-azobis(2-methyl-N-(2-hydroxyethyl)-propionamido) acting as a water-soluble initiator: VA-086 (trade name) manufactured by Wako Pure Chemical Industries, Ltd. was put into the reactor in which polymerization continued for 4 hours. After the polymerization, the resultant admixture was cooled down, and the reaction was then terminated. A water dispersion of colored polymer particles was thus obtained. A solid matter concentration of the water dispersion containing colored polymer particles was 27% by weight. And then, sulfuric acid was added to the water dispersion containing colored polymer particles until pH thereof became 4 so that magnesium hydroxide on the surfaces of colored polymer particles was solubilized into water. The dispersion obtained after magnesium hydroxide had been solubilized was supplied to a continuous belt filter: Eagle Filter (trade name) manufactured by Sumitomo Heavy Industries, Ltd., to be thereby subjected to cleaning and deliquoring with ion-exchanged water of which amount was ten times as much as the solid matter. A moisture content of wet colored polymer particle cake thus obtained was 35%.

The ion-exchanged water was added to the wet colored polymer particle cake so that the colored polymer particles were dispersed again to prepare a colored polymer particle dispersion having a solid matter concentration of 20%. Next, a five-layered porous metal body: Fuji Plate (trade name) manufactured by Fuji Filter MFG, Co., Ltd., which had been produced by vacuum sintering and which was made of stainless steel, having a filtering accuracy of 2 μm, was fixed as a filter element onto a basket-type centrifugal filter: KM-20 type (trade name) manufactured by Matsumoto Kikai Co., Ltd. And then, 600 parts of the above dispersion is supplied for about 3 minutes to the filter rotating at 500 G of centrifugal effect. After all the colored polymer particle dispersion had been supplied, the basket-type centrifugal filter was accelerated to 1200 G of centrifugal effect to perform deliquoring for 4 minutes. After the deliquoring, the filtered cake was scraped off from the basket-type centrifugal filter by use of a filtered cake scraping device so that the filter cake having a thickness of 5 mm remained. All the remained cake having a thickness of 5 mm was then collected by air blow. At the time, a solid matter concentration of filtered liquid was 0 ppm, and a moisture content of the filtered cake was 12.9%. This operation was repeated twenty times, but a filtering speed was not decreased. The filtered cake thus obtained was dried in a vacuum drier for 8 hours at a temperature of 50° C. to obtain toner particles having a volumetric average particle diameter of 6.9 μm and CV of 25. And then, 0.6 part of hydrophobized colloidal silica: RX-300 (trade name) manufactured by Nippon Aerosil Co., Ltd. was added to 100 parts of the obtained toner particles, which were then mixed by using the Henschel mixer so that the toner for comparison was obtained.

[Pigment Dispersibility]

By use of a transmission electron microscope (abbreviated as TEM), the toner of Example 1 and the toner of Comparative example 1 were observed, and TEP images of the toner were analyzed by using an image analysis software: A-zo kun (trade name) manufactured by Asahi Kasei Engineering Corporation to thereby obtain a ratio $D_{total}$ (hereinafter referred to as "an area ratio of the entire pigment") of a total area of all the pigments contained in the observed region to a total area of the observed region, and a ratio $D_{0.1}$ (hereinafter referred to as "the area ratio of the pigment having a particle diameter of 0.1 μm or less") of a total area of the pigment having a particle diameter of 0.1 μm or less contained in the observed region to the total area of the observed region. A dispersion rate D(%) was calculated based on the following formula (1) using the area ratio $D_{total}$ of the entire pigment thus obtained and the area ratio $D_{0.1}$ of the pigment having a particle diameter of 0.1 μm or less. The calculated dispersion rate D(%) was used as an evaluation index of the pigment dispersibility so that the pigment dispersibility was evaluated based on the following criteria.

Good: Excellent. The dispersion rate D is 90% or more.

Not bad: Practicable. The dispersion rate D is 85% or more and less than 90%.

Poor: Hardly practicable. The dispersion rate D is less than 85%.

$$D(\%)=D_{0.1}/D_{total}\times 100 \quad (1)$$

[Image Density]

From a commercially available image forming apparatus: digital full color multifunction printer AR-150 (trade name) manufactured by Sharp Corporation, a fixing device was removed. A developer tank of developing device of the apparatus was filled with each of the toner of Example 1 and toner of Comparative example 1 to thereby form an unfixed test image including a solid image part, such that a toner amount attached to a recording sheet: recording sheet for full color PP106A4C (trade name) manufactured by Sharp Corporation was 0.6 mg/cm$^2$. The unfixed image thus formed was fixed onto the recording sheets by use of an external fixing machine. The fixed image thus obtained was defined as an evaluation image. As the external fixing machine, a commercially available image forming apparatus: digital full color multifunction printer AR-150 (trade name) manufactured by Sharp Corporation was remodeled and then used as a fixing device. By use of a spectral calorimetric densitometer: X-Rite 938 (trade name) manufactured by Nippon Heiban Insatsukizai Co., an optical density of the solid image part on the obtained evaluation image was measured. The measured optical density was used as an evaluation index of the image density so that the image density was evaluated based on the following criteria.

Good: Excellent. The optical density is 1.35 or more.

Not bad: Practicable. The optical density is 1.30 or more and less than 1.35.

Poor: Hardly practicable. The optical density is less than 1.30.

[Fogging Level]

At the outset, whiteness defined by JIS P8148 on an A4-sized recording sheet (recording sheet for full color PP106A4C) defined by JIS P0138 was measured by use of a whiteness checker: Z-Σ90 Color Measuring System (trade name) manufactured by Nippon Denshoku Industries Co., Ltd. The obtained value was defined as a first measurement value W1. Each of the toner of Example 1 and toner of Comparative example 1 was put in a developing tank of developing device of commercially available copier: AR-620 (trade name) manufactured by Sharp Corporation, to thereby form a sample image containing a white circle part having a diameter of 55 mm and a black solid part surrounding the white circle part onto three recording sheets of which measured whiteness was a level defined by JIS P8148d. The sample image thus obtained was defined as an evaluation image. By use of the above-described whiteness checker, whiteness of the white circle part on each of the evaluation images was measured, and an average thereof was then calculated. The obtained average value was defined as a second measurement value W2. A fogging density W(%) was calculated based on the following formula (2) using the first measurement value W1 and the second measurement value W2. The calculated fogging level W was used as an evaluation index of the fogging level so that the fogging level was evaluated based on the following criteria.

Good: Excellent. The fogging level is less than 1.0%.

Not bad: Practicable. The fogging level is 1.0% or more and less than 1.5%.

Poor: Hardly practicable. The fogging level is 1.5% or more.

$$W(\%)=[(W1-W2)/W1]\times 100 \quad (2)$$

[Transferring Property]

Each of the toner of Example 1 and the toner of Comparative example 1 was put in a developer tank of developing device of commercially available multifunction printer: AR-620 (trade name) manufactured by Sharp Corporation, to thereby make a copy of a predetermined chart containing a solid image part onto a recording sheet (recording sheet for full color PP106A4C). A weight Mp (mg/cm$^2$) of transferred toner (hereinafter referred to as "transferred toner amount") in the solid image part per section area of the recording sheet was then measured. Moreover, a weight Md (mg/cm$^2$) of remaining toner (hereinafter referred to as "remaining toner amount") per section area in a part of a photoreceptor used for making the copy, where the solid image part had been formed, was measured. The weight of toner was measured under circumstances of a temperature of 20° C. and a relative humidity of 50% RH. A transfer ratio T(%) was calculated based on the following formula (3) using the measured transferred toner amount Mp and remaining toner amount Md. The calculated transfer ratio T was used as an evaluation index of the transfer ratio so that the transfer ratio was evaluated based on the following criteria.

Good: Excellent. The transfer ratio T is 90% or more.

Poor: Hardly practicable. The transfer ratio T is less than 90%.

$$T(\%)=[Mp/(Md+Mp)]\times 100 \quad (3)$$

TABLE 1

| | | Example 1 | Comparative Example 1 |
|---|---|---|---|
| Colorant | | Composite particle | Master batch |
| Pigment | D(%) | 95 | 89 |
| Dispersibility | Evaluation | Good | Not bad |
| Image Density | Optical Density | 1.37 | 1.31 |
| | Evaluation | Good | Not bad |
| Fogging Level | W(%) | 0.3 | 1.2 |
| | Evaluation | Good | Not bad |
| Transferring Property | T(%) | 94 | 89 |
| | Evaluation | Good | Poor |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner, comprising granulating by applying a shearing force and a collision force to a kneaded product of toner raw material containing binder resin and a colorant in water under heat at a temperature in the range of from 5000 to 15000 and pressure in the range of from 0.13 MPa to 0.3 MPa and in the presence of a water-soluble polymeric dispersant with preventing the generation of bubbles, wherein the shearing force and the collision force are applied to the kneaded product of toner raw material containing the binder resin and the colorant by use of a granulator comprising:

a cylindrical pressure-resistant container having an internal space, which can be hermetically closed;

a spinning rotor which is provided in the internal space of the cylindrical pressure-resistant container and supported on one face or both faces in a thickness direction of the pressure-resistant container so as to be rotatable, having a shaft center in common with the pressure-resistant container and containing stirring blades which initiate flow of the kneaded product of toner and raw material in the radial direction;

a following screen having a shape of tube, which has a shaft center in common with the cylindrical pressure-resistant container and is provided around the spinning rotor so as to be rotatable with rotation of the spinning rotor, and of which peripheral wall is provided with a plurality of slits for flowing a liquid; and a fixed screen having a shape of tube, which has a shaft center in common with the cylindrical pressure-resistant container and is provided around the following screen, and of which peripheral wall is provided with a plurality of slits for flowing a liquid.

2. The method of claim 1, wherein the binder resin is one or more ingredients selected from polyester, acrylic resin, polyurethane, and epoxy resin.

3. The method of claim 1, wherein the binder resin is polyester.

4. The method of claim 1, wherein the kneaded product of toner raw material contains a release agent and/or a charge control agent together with the binder resin and the colorant.

5. The method of claim 1, wherein the water-soluble polymeric dispersant is one or more water-soluble polymeric dispersants selected from polyoxyalkylene alkylarylether sulfate salt and polyoxyalkylene alkylether sulfate salt.

6. The method of claim 1, wherein the kneaded product of toner raw material containing the binder resin and the colorant is obtained by kneading the toner raw material in an open roll type kneader.

7. A method of claim 1, wherein the water-soluble polymeric dispersant is one or more water-soluble acrylic polymer type dispersants polymerized by the hydrophilic monomers selected from a carboxyl- or a cyano-containing acrylic monomer, an ester-containing acrylic monomer, an amide-containing acrylic monomer, a vinyl alkylether, a vinyl alkylester, (metha)acrylonitrile, an acid chloride-containing acrylic monomer, a vinyl-nitrogen-containing hetericyclic monomer, and a cross linking monomer, or polyvinylalcohol.

8. A method of manufacturing a toner, comprising granulating by applying a shearing force and a collision force to a kneaded product of toner raw material containing binder resin and a colorant in water under heat at a temperature in the range of from 50° C. to 150° C. and pressure in the range of from 0.13 MPa to 0.3 MPa and in the presence of a water-soluble polymeric dispersant with preventing the generation of bubbles, wherein the shearing force and the collision force are applied to the kneaded product of toner raw material containing the binder resin and the colorant by use of a granulator comprising:

a cylindrical pressure-resistant container having an internal space, which can be hermetically closed;

a spinning rotor which is provided in the internal space of the cylindrical pressure-resistant container and supported on one face or both faces in a thickness direction of the pressure-resistant container so as to be rotatable, having a shaft center in common with the pressure-resistant container and containing stirring blades which initiate flow of the kneaded product of toner and raw material in the radial direction;

a following screen having a shape of tube, which has a shaft center in common with the cylindrical pressure-resistant container and is provided around the spinning rotor so as to rotate with rotation of the spinning rotor, said following screen having a peripheral wall containing a plurality of slits which allow flow through of liquid and provide shearing of said kneaded product of toner and raw material; and a fixed screen having a shape of tube, which has a shaft center in common with the cylindrical pressure-resistant container and is provided around the following screen, and of which peripheral wall is provided with a plurality of slits for flowing a liquid, said fixed screen being a screen which does not rotate with said rotor.

9. The method of claim 1 wherein the container further contains an additional rotating screen which is similar to said following screen and positioned between said following screen and said fixed screen.

10. A method of manufacturing a toner, comprising granulating by applying a shearing force and a collision force to a kneaded product of toner raw material containing binder resin and a colorant in water under heat at a temperature in the range of from 50° C. to 150° C. and pressure in the range of from 0.13 MPa to 0.3 MPa and in the presence of a water-soluble polymeric dispersant with preventing the generation of bubbles, wherein the shearing force and the collision force are applied to the kneaded product of toner raw material containing the binder resin and the colorant by granulating said kneaded product in a cylindrical pressure-resistant container having an internal space, which is hermetically closed;

said container containing a spinning rotor which is provided in the internal space of the container and supported on one face or both faces in a thickness direction of the container and is rotated to mix said kneaded product, said spinning rotor having a shaft center in common with the container and said spinning rotor containing stirring blades which initiate flow of the kneaded product in the radial direction in the container;

said container further containing a following screen having a tube shape, which has a shaft center in common with the container and is provided around the spinning rotor so as to rotate with rotation of the spinning rotor, said following screen having a peripheral wall containing a plurality of slits wherein liquid flows through, said plurality of slits acting to shear the radially flowing kneaded product; and said container further containing a fixed screen having a tube shape, which has a shaft center in common with the container and is provided around the following screen, said fixed screen having a peripheral wall which contains a plurality of slits wherein liquid flows through, said fixed screen being a screen which does not rotate with said rotor.

11. The method of claim 10, wherein the binder resin is one or more ingredients selected from polyester, acrylic resin, polyurethane, and epoxy resin.

12. The method of claim 10, wherein the binder resin is polyester.

13. The method of claim 10, wherein the kneaded product of toner raw material contains a release agent and/or a charge control agent together with the binder resin and the colorant.

14. The method of claim 10, wherein the water-soluble polymeric dispersant is one or more water-soluble polymeric dispersants selected from polyoxyalkylene alkylarylether sulfate salt and polyoxyalkylene alkylether sulfate salt.

15. The method of claim 10, wherein the kneaded product of toner raw material containing the binder resin and the colorant is obtained by kneading the toner raw material in an open roll type kneader.

16. A method of claim 10, wherein the water-soluble polymeric dispersant is one or more water-soluble acrylic polymer type dispersants polymerized by the hydrophilic monomers selected from a carboxyl- or a cyano-containing acrylic monomer, an ester-containing acrylic monomer, an amide-containing acrylic monomer, a vinyl alkylether, a vinyl alkylester, (metha)acrylonitrile, an acid chloride-containing acrylic monomer, a vinyl-nitrogen-containing hetericyclic monomer, and a cross linking monomer, or polyvinylalcohol.

* * * * *